US007880708B2

(12) United States Patent
Chen

(10) Patent No.: US 7,880,708 B2
(45) Date of Patent: Feb. 1, 2011

(54) POWER CONTROL METHOD AND SYSTEM FOR POLARITY INVERSION IN LCD PANELS

(75) Inventor: Ping Po Chen, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 696 days.

(21) Appl. No.: 11/758,334

(22) Filed: Jun. 5, 2007

(65) Prior Publication Data

US 2008/0303773 A1 Dec. 11, 2008

(51) Int. Cl.
*G09G 3/36* (2006.01)

(52) U.S. Cl. ..... 345/96; 345/87

(58) Field of Classification Search ..... None
See application file for complete search history.

(56) References Cited

U.S. PATENT DOCUMENTS 6,094,192 A * 7/2000 Kobayashi et al. ..... 345/210
7,369,187 B2 * 5/2008 Park ..... 349/38
2002/0122030 A1 * 9/2002 Stiens et al. ..... 345/178
2004/0041773 A1 * 3/2004 Takeda et al. ..... 345/98
2004/0070559 A1 * 4/2004 Liang ..... 345/87
2005/0007324 A1 * 1/2005 Inada ..... 345/87
2005/0088395 A1 * 4/2005 Chung ..... 345/98
2006/0103618 A1 * 5/2006 Miura ..... 345/96
2006/0119596 A1 * 6/2006 Lin ..... 345/211
2008/0001876 A1 * 1/2008 Ito et al. ..... 345/87

* cited by examiner

*Primary Examiner*—Bipin Shalwala
*Assistant Examiner*—Daniel Bedell
(74) *Attorney, Agent, or Firm*—WPAT, P.C.; Anthony King

(57) ABSTRACT

A power control method for polarity inversion in an LCD panel comprises the step of providing a storage capacitor on a circuit board. Thereafter, the storage capacitor is charged to a first middle voltage. Next, the voltage of the VCOM channel is pulled up by a common output amplifier, only from the first middle voltage to a first upper voltage during a positive polarity period. Also, the voltage of the VCOM channel is pulled down by the common output amplifier, only from the first middle voltage to a first lower voltage during a negative polarity period.

17 Claims, 3 Drawing Sheets

POWER CONTROL METHOD AND SYSTEM FOR POLARITY INVERSION IN LCD PANELS

BACKGROUND OF THE INVENTION

1. Field of the Invention

The present invention relates to a power control method and a power control system for polarity inversion in an LCD panel, and more particularly, to a power control method and a power control system for line inversion in an LCD panel.

2. Description of the Related Art

LCD (Liquid Crystal Display) panels are widely used in PDAs (Personal Digital Assistants), mobile phones, and other personal mobile instruments. As sizes of personal mobile instruments are reduced, the size of the LCD panels used therein has to decrease accordingly. Single chip design is an option to meet the requirement of reduced sizes of personal mobile instruments. In general, only one power voltage (e.g. 3.5 volts) is provided in the single chip, which supports different components that require different levels of voltage. For example, there are various voltage levels used in a single chip TFT (Thin Film Transistor) LCD driver including a system voltage (e.g., 3.3 volts with the symbol of VDD), a source driver voltage (e.g., 5 volts with the symbol of VDDA), gate driver voltages (e.g., −15 volts and 15 volts with the symbols of VGH and VGL), and a common voltage (e.g., varying from −1 volt to 4.5 volts with the symbol of VCOM), which are generated from the power voltage (e.g., 3.5 volts). For modern applications of 3G (or 3.5G) mobile phones and 3.5 inch LCD displays used in automobiles, the power driving capacity designed in the single chip used for a 2.4 inch LCD panel is no longer valid due to larger source driving current and common switching current (for polarity inversion) in modern applications. Thus, the source driving current and common switching current become the bottlenecks of power circuit design and have to be reduced.

FIG. 1 shows a traditional configuration of a source driver 1 and an LCD panel 2. The source driver 1 includes plural source driver outputs 11 (only one source driver output is shown) and a common output amplifier 12. Each source driver output 11 provides a source driver current to a corresponding pixel that is equivalent to a pixel capacitive loading Cs. The common output amplifier 12 provides a common switching current to a common capacitive loading $C_{COM}$ during line polarity inversion. According to formula (1) below, there are three ways to reduce the current I; that is, to reduce scanning frequency f, to reduce the capacitance C of the capacitive loading, and to reduce the voltage V across the capacitive loading.

$$I=f\times C\times V \tag{1}$$

However, the scanning frequency f is associated with image quality and the capacitance C is associated with the panel size. Thus, these two factors (f and C) are expected to remain unchanged and the only way to reduce the current I is to reduce the voltage V.

SUMMARY OF THE INVENTION

The present invention discloses a power control method for polarity inversion in an LCD panel. The power control method includes the steps of: (a) charging a VCOM channel capacitor from a first lower voltage to a first middle voltage by a storage capacitor during a positive polarity period, (b) charging the VCOM channel capacitor from the first middle voltage to a first upper voltage during the positive polarity period, (c) discharging the VCOM channel capacitor from the first upper voltage to the first middle voltage through the storage capacitor during a negative polarity period; and (d) discharging the VCOM channel capacitor from the first middle voltage to the first low voltage during the negative polarity period. In another embodiment, the power control method further includes the steps of: (e) charging a plurality of capacitive loadings from a second lower voltage to a second middle voltage, (f) charging the capacitive loadings from the second middle voltage to corresponding data voltages that are below the first upper voltage, (g) discharging the capacitive loadings from the corresponding data voltages to the second middle voltage through the storage capacitor, and (h) discharging the capacitive loadings from the second middle voltage to the second lower voltage.

The second embodiment of the present invention comprises the step of providing a storage capacitor on a circuit board. Thereafter, the storage capacitor is charged to a first middle voltage. Next, the voltage of the VCOM channel is pulled up by a common output amplifier, only from the first middle voltage to a first upper voltage during a positive polarity period. Also, the voltage of the VCOM channel is pulled down by the common output amplifier, only from the first middle voltage to a first lower voltage during a negative polarity period.

The present invention also provides a power control system for polarity inversion in an LCD panel. The power control system includes an LCD panel, a storage capacitor, and a source driver. The LCD panel includes plural capacitive loadings and a VCOM channel capacitor. The storage capacitor shares a charge with the VCOM channel capacitor and the capacitive loadings. The source driver includes a common output amplifier, plural source driver outputs, plural first source switches, plural second source switches, and a third source switch. The common output amplifier charges the VCOM channel capacitor from a first middle voltage to a first upper voltage. The source driver outputs charge corresponding capacitive loadings in the LCD panel from a second middle voltage to corresponding data voltages. The first source switches control the charging operation of the source driver outputs. The second source switches control the charge sharing between the capacitive loadings and the storage capacitor. The third source switch controls the charge sharing between the VCOM channel capacitor and the storage capacitor. In another embodiment, the power control system further includes a common center amplifier controlled by a fourth switch to precharge the storage capacitor to the first middle voltage.

BRIEF DESCRIPTION OF THE DRAWINGS

The invention will be described according to the appended drawings in which.

DETAILED DESCRIPTION OF THE INVENTION

Figure 2:
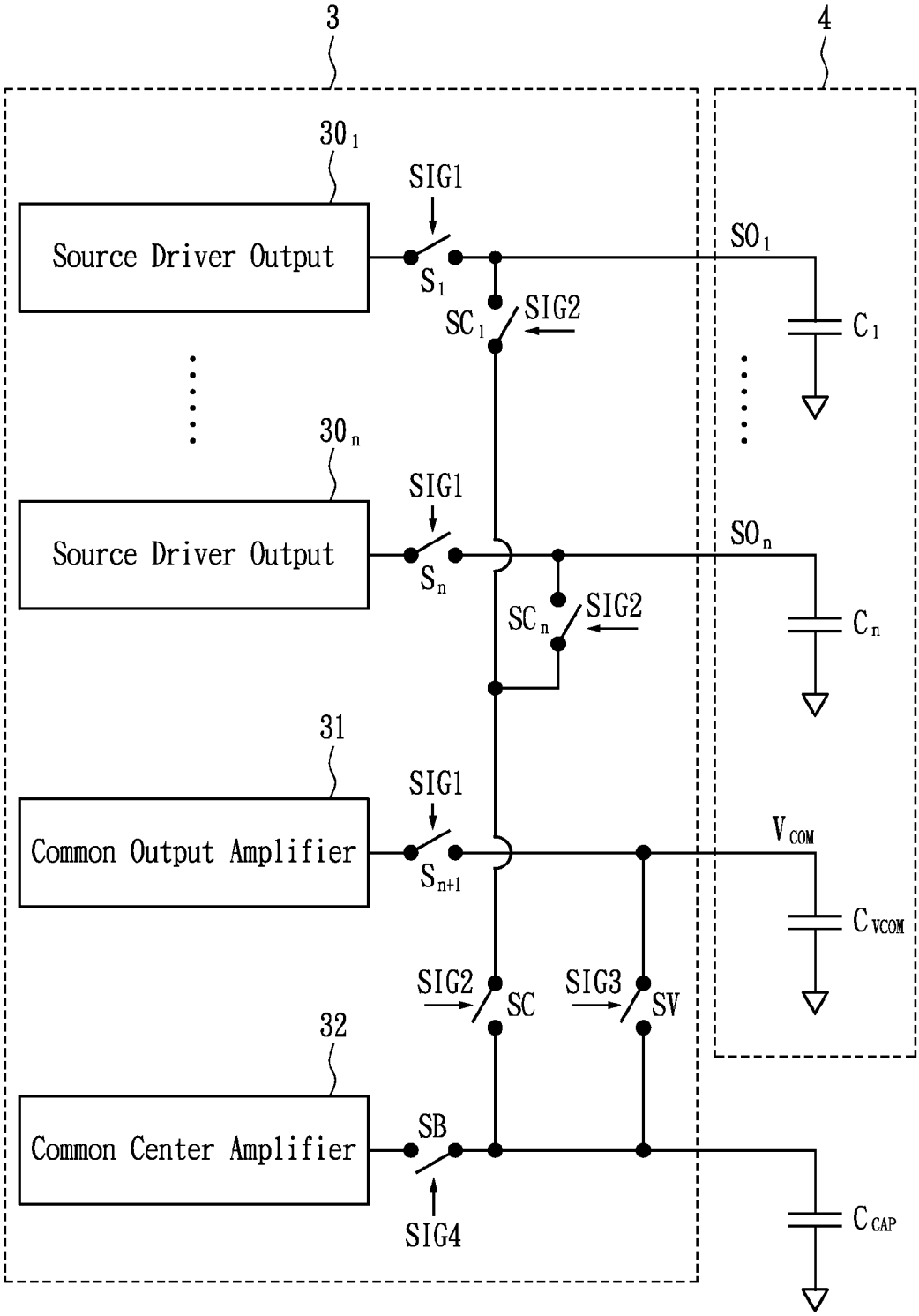
FIG. 2 shows an embodiment of a power control system for polarity inversion in an LCD panel in accordance with the present invention.
Figure 3:
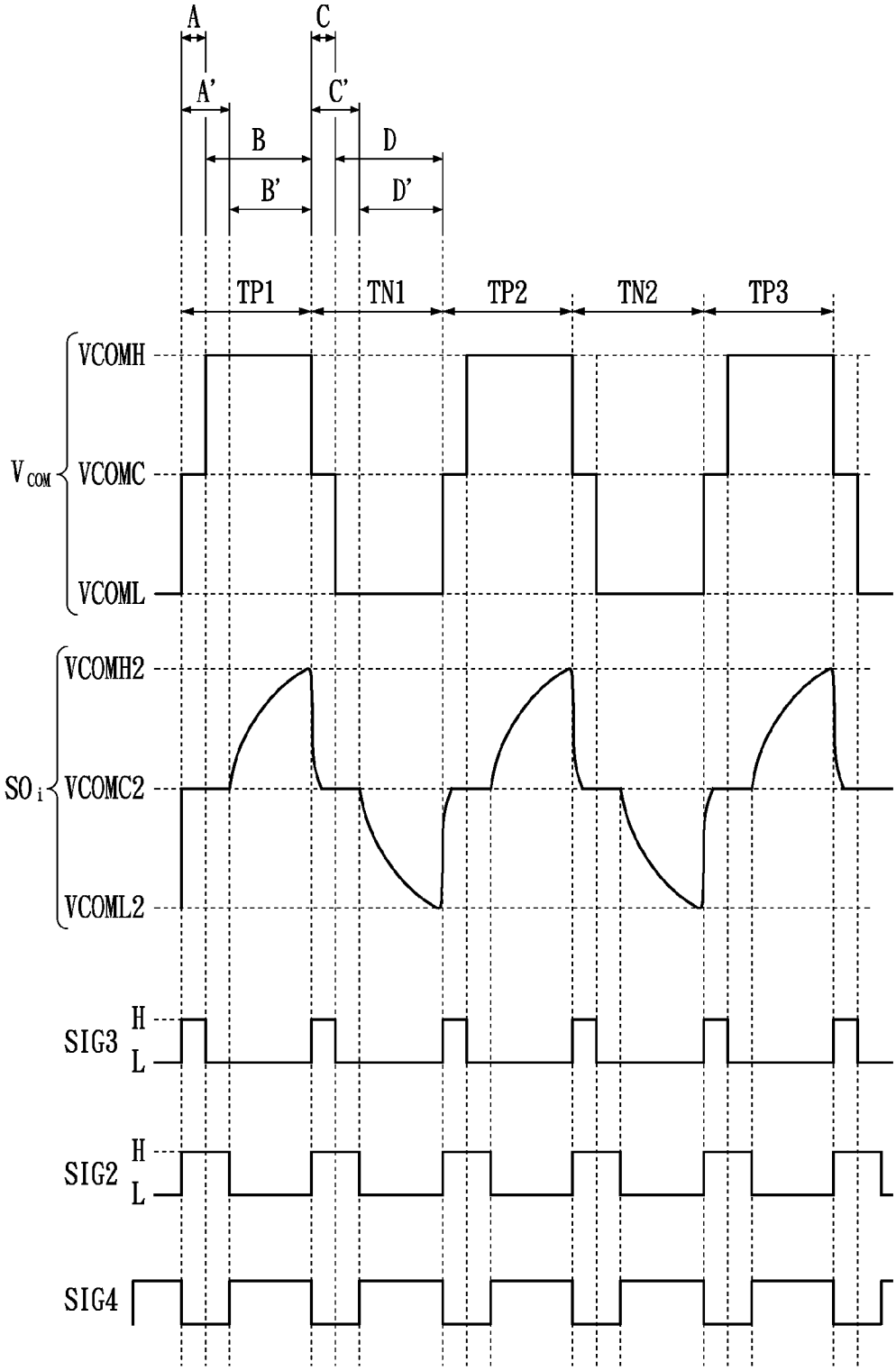
FIG. 3 illustrates a timing chart regarding the common voltage, the source output voltages, the second control signal, and the third control signal of FIG. 2.

FIG. 2 shows an embodiment of a power control system for polarity inversion in an LCD panel according to the present invention. FIG. 3 illustrates a timing chart regarding the common voltage VCOM, the source output voltages SOi, the second control signal SIG2, and the third control signal SIG3 of FIG. 2. The power control system includes a source driver 3, a storage capacitor $C_{CAP}$ (about 1 μF) on a circuit board, and an LCD panel 4. The capacitance of the storage capacitor is, for example, greater than that of a VCOM channel capacitor of the LCD panel at least 10 times. The LCD panel 4 includes plural capacitive loadings $C_1$-$C_n$ (about 15 to 20 pF) that correspond to plural pixels in the LCD panels 4, and a VCOM channel capacitor $C_{VCOM}$ (about 15 nF). The storage capacitor $C_{CAP}$, which is placed on a circuit board or other suitable places, is used to recycle and share charge with the VCOM channel capacitor $C_{VCOM}$ and the capacitive loadings $C_1$-$C_n$ during line polarity inversion. The capacitance of the storage capacitor $C_{CAP}$ is much larger than that of the VCOM channel capacitor $C_{VCOM}$ and capacitive loadings $C_1$-$C_n$. The source driver 3 includes a common output amplifier 31, a common center amplifier 32, plural source driver outputs $\mathbf{30}_1$-$\mathbf{30}_n$, plural first source switches $S_1$-$S_n$, plural second source switches $SC_1$-$SC_n$ and SC, and a third source switch SV. The common output amplifier 31 is used to charge the VCOM channel capacitor $C_{VCOM}$ from a first middle voltage VCOMC to a first upper voltage VCOMH. The source driver outputs $\mathbf{30}_1$-$\mathbf{30}_n$ are used to charge corresponding capacitive loadings $C_1$-$C_n$ in the LCD panel 4 from a second middle voltage VCOMC2 to corresponding data voltages that indicate proper pixel values. The first source switches $S_1$-$S_n$, which receive respective first control signals SIG1, are used to control the charging operation of the source driver outputs $\mathbf{30}_1$-$\mathbf{30}_n$. The second source switches $SC_1$-$SC_n$ and SC, which receive respective second control signals SIG2, are used to control the charge sharing between the capacitive loadings $C_1$-$C_n$ and the storage capacitor $C_{CAP}$. The third source switch SV, which receives a third control signal SIG3, is used to control the charge sharing between the VCOM channel capacitor $C_{VCOM}$ and the storage capacitor $C_{CAP}$. The common center amplifier 32 is controlled by a fourth switch SB that is actuated by a fourth control signal SIG4 upon power-on or other situations to precharge the storage capacitor $C_{CAP}$ to the first middle voltage VCOMC.

Figure 1:
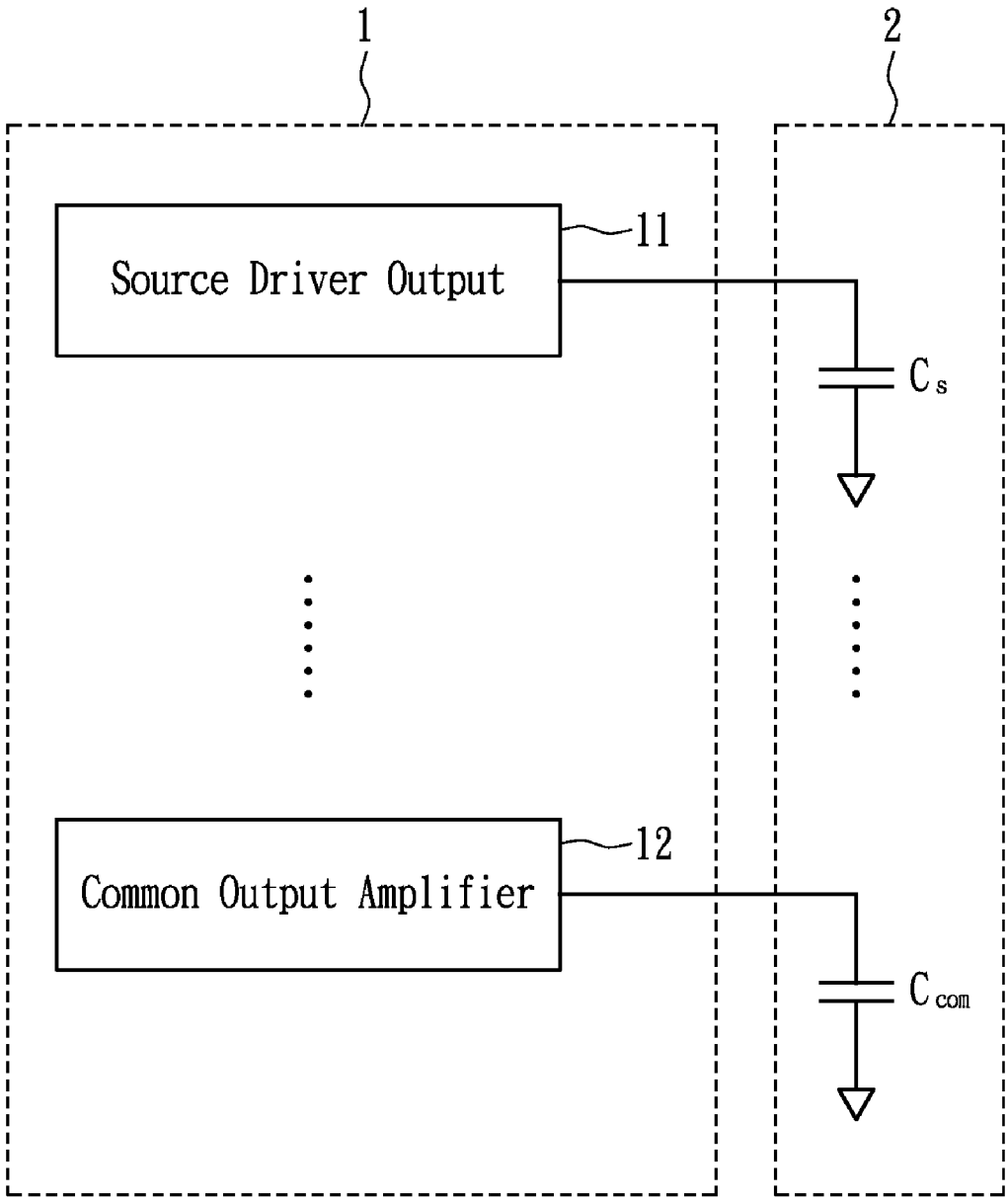
FIG. 1 (Prior Art)
FIG. 1 shows a traditional configuration of a source driver and an LCD panel.

The following gives an embodiment of a power control method for polarity inversion according to the embodiments of the present invention. Referring to FIGS. 2 and 3, the storage capacitor $C_{CAP}$ is added compared with FIG. 1. First, before the first positive polarity period TP1, the common center amplifier 32 precharges the storage capacitor $C_{CAP}$ to the first middle voltage VCOMC by closing the fourth source switch SB actuated by the fourth control signal at a high logic state. Then, the fourth switch SB is open. Second, entering the first positive polarity period TP1, the VCOM channel capacitor $C_{VCOM}$ is charged from the first lower voltage VCOML to the first middle voltage VCOMC by the storage capacitor $C_{CAP}$ with the third source switch SV closed and the third control signal SIG3 at the high logic state. That is, the VCOM channel capacitor $C_{VCOM}$ is charged to the first middle voltage VCOMC through charge sharing with the storage capacitor $C_{CAP}$, and without the assistance of the common output amplifier 31. Meanwhile, the second source switches $SC_1$-$SC_n$ and SC are closed with the second control signal SIG2 at the high logic state to charge the capacitive loadings $C_1$-$C_n$ from the second lower voltage VCOML2 to the second middle voltage VCOMC2. This means that the capacitive loadings $C_1$-$C_n$ are charged through charge sharing with the storage capacitor $C_{CAP}$. Then, the second control signal SIG2 goes to a low logic state to open the second source switches $SC_1$-$SC_n$ and SC. At this moment, the common voltage $V_{COM}$ of the storage capacitor $C_{CAP}$ is at the first middle voltage VCOMC, and the source output voltages $SO_i$ of the capacitive loadings $C_1$-$C_n$ are at the second middle voltage VCOMC2 that is close to the first middle voltage VCOMC. After that, the first source switches $S_1$-$S_{n+1}$ are closed by the first control signal SIG1 at high logic state to charge the VCOM channel capacitor $C_{VCOM}$ from the first middle voltage CVOMC to the first upper voltage VCOMH, and to charge the capacitive loadings $C_1$~$C_n$ from the second middle voltage VCOMC2 to corresponding data voltages VCOMH2 that are below the first upper voltage VCOMH. Note that the second middle voltage VCOMC2 is close to the first middle voltage VCOMC, the high-logic-state period of the second control signal SIG2 is longer than that of the third control signal SIG3, and the levels of the corresponding data voltages VCOMH2 depend on corresponding pixel values. Also, the first middle voltage VCOMC is an average of the first low voltage VCOML and the first upper voltage VCOMH.

Next, entering the first negative polarity period TN1, the VCOM channel capacitor $C_{VCOM}$ is discharged from the first upper voltage VCOMH to the first middle voltage VCOMC through the storage capacitor $C_{CAP}$, in which the third source switch SV is closed by the third control signal SIG3 at the high logic state. That is, the VCOM channel capacitor $C_{VCOM}$ is discharged through charge sharing with the storage capacitor $C_{CAP}$. Meanwhile, the capacitive loadings $C_1$~$C_n$ are discharged from the corresponding data voltages VCOMH2 to the second middle voltage VCOMC2 through the storage capacitor $C_{CAP}$, in which the second source switches $SC_1$-$SC_n$ and SC are closed by the second control signal SIG2 at the high logic state. This means that the capacitive loadings $C_1$~$C_n$ are discharged through charge sharing with the storage capacitor $C_{CAP}$. Then, the second and third control signals SIG2 and SIG3 switch to the low logic state to open the second source switches $SC_1$-$SC_n$ and SC, and the third source switch SV, respectively. The first source switches $S_1$-$S_{n+1}$ are closed by the first control signal SIG1 at high logic state to discharge the VCOM channel capacitor $C_{VCOM}$ from the first middle voltage CVOMC to the first low voltage VCOML, and to discharge the capacitive loadings $C_1$~$C_n$ from the second middle voltage VCOMC2 to the second lower voltage VCOML2 that are above the first lower voltage VCOML. The operations during the second and third positive polarity period TP2 and TP3, and the second negative polarity period TN2, which are similar to those during the first positive and negative polarity period TP1 and TN1, are skipped.

According to the above embodiments, the charge stored in the storage capacitor $C_{CAP}$, which exhibits the first middle voltage VCOMC, is recycled during each line polarity inversion. Referring to FIG. 3, during the first positive polarity period TP1, the charge stored in the storage capacitor $C_{CAP}$ is used to charge the VCOM channel capacitor $C_{VCOM}$ during period A and to charge the capacitive loadings $C_1$-$C_n$ during period A'. During the first negative polarity period TN1, the charge that is provided from the storage capacitor $C_{CAP}$ is discharged from the VCOM channel capacitor $C_{VCOM}$ and from the capacitive loadings $C_1$-$C_n$ to the storage capacitor $C_{CAP}$ during period C and during period C', respectively. In other words, during the positive and negative polarity periods (e.g., TP1 and TN1), the source driver outputs $\mathbf{30}_1$-$\mathbf{30}_n$ and the common output amplifier 31 provide driving currents only during period B and period B', respectively, and draw currents only during period D and period D', respectively. Therefore, the common switching current (flowing through the common output amplifier 31) and the source driving current (flowing through the source driver outputs $\mathbf{30}_1$-$\mathbf{30}_n$) are only half-swing and effectively reduced according to the embodiments of the present invention.

In addition, Vcap depends on charge sharing of SO(i) and Vcom, plus another charge sharing derived from the original Vcap voltage. The adjusted Vcap is not fixed, but rather is close to original Vcap. Ccap is far larger than Cvcom and C-so(i). For example, Ccap=1 uF, Cvcom=15 nF, and the variation of voltage sharing is about 1.5%. It is not necessary to maintain Vcap directly by the system, but to maintain charge re-cycle by summation of positive and negative polarities of SO(i) and VCOM.

One aspect of the present invention is to provide a power control method for polarity inversion in an LCD panel, by charging a VCOM channel capacitor from a first lower voltage to a first middle voltage by a storage capacitor and discharging the VCOM channel capacitor from a first upper voltage to the middle voltage through the storage capacitor, to reduce a common switching current.

Another aspect of the present invention is to provide a power control system for polarity inversion in an LCD panel, by adding the storage capacitor providing the first middle voltage, to reduce the common switching current.

The above-described embodiments of the present invention are intended to be illustrative only. Numerous alternative embodiments may be devised by those skilled in the art without departing from the scope of the following claims.

What is claimed is:

1. A power control method for polarity inversion in an LCD panel, comprising:

providing a storage capacitor, wherein the capacitance of the storage capacitor is greater than that of a VCOM channel capacitor of the LCD panel;

charging the storage capacitor to a first middle voltage with a common center amplifier;

charging the VCOM channel capacitor with a VCOM common output amplifier from the first middle voltage to a first upper voltage during a positive polarity period; and discharging the VCOM channel capacitor through the storage capacitor from the first upper voltage to the first middle voltage during a negative polarity period.

2. The power control method of claim 1, further comprising the steps of:

charging source line channels of the LCD panel with source drivers only from the first middle voltage to the first upper voltage during the positive polarity period; and discharging the source line channels with source drivers only from the first middle voltage to the first lower voltage during the negative polarity period.

3. The power control method of claim 1, wherein the storage capacitor is connected to the VCOM channel capacitor through a VCOM switch, which is enabled at the beginning of the positive and negative polarity periods.

4. The power control method of claim 2, wherein the storage capacitor is connected to the VCOM channel capacitor through a VCOM switch, which is enabled at the beginning of the positive and negative polarity periods.

5. A power control method for polarity inversion in an LCD panel, comprising:

charging a VCOM channel capacitor with a storage capacitor from a first lower voltage to a first middle voltage during a positive polarity period, wherein the storage capacitor has been charged to the first middle voltage with a common center amplifier;

charging the VCOM channel capacitor with a VCOM output amplifier from the first middle voltage to a first upper voltage during the positive polarity period;

discharging the VCOM channel capacitor through the storage capacitor from the first upper voltage to the first middle voltage during a negative polarity period; and discharging the VCOM channel capacitor through a VCOM output amplifier from the first middle voltage to the first low voltage during the negative polarity period.

6. The power control method of claim 5, wherein the charging of the VCOM channel capacitor is performed through charge sharing with the storage capacitor.

7. The power control method of claim 5, wherein the discharging of the VCOM channel capacitor is performed through charge sharing with the storage capacitor.

8. The power control method of claim 5, wherein the capacitance of the storage capacitor is placed on a circuit board and is larger than that of the VCOM channel capacitor.

9. The power control method of claim 5, wherein the first middle voltage is an average of the first low voltage and the first upper voltage.

10. The power control method of claim 5, further comprising the step of precharging the storage capacitor to the first middle voltage, which is performed before the charging of the VCOM channel capacitor.

11. The power control method of claim 5, further comprising the steps of:

charging a plurality of capacitive loadings from a second lower voltage to a second middle voltage;

charging the capacitive loadings from the second middle voltage to corresponding data voltages that are below the first upper voltage;

discharging the capacitive loadings from the corresponding data voltages to the second middle voltage through the storage capacitor; and discharging the capacitive loadings from the second middle voltage to the second lower voltage.

12. The power control method of claim 11, wherein the charging of the capacitive loadings is performed through charge sharing with the storage capacitor.

13. The power control method of claim 11, wherein the discharging of the capacitive loadings is performed through charge sharing with the storage capacitor.

14. The power control method of claim 11, wherein the period of the charging of the capacitive loadings is longer than that of the charging of the VCOM channel capacitor.

15. The power control method of claim 11, wherein the period of the discharging of the capacitive loadings is longer than that of the discharging of the VCOM channel capacitor.

16. A power control system for polarity inversion in an LCD panel, comprising:

a storage capacitor performing charge sharing with a VCOM channel capacitor of the LCD panel from a first lower voltage to a first middle voltage and sharing charges with capacitive loadings of the LCD panel from a second lower voltage to a second middle voltage; and a source driver, comprising:

a common output amplifier charging the VCOM channel capacitor from a first middle voltage to a first upper voltage;

a plurality of source driver outputs charging corresponding capacitive loadings from a second middle voltage to corresponding data voltages;

a plurality of first source switches controlling the charging operation of the source driver outputs;

a plurality of second source switches controlling the charge sharing between the capacitive loadings and the storage capacitor;

a third source switch controlling the charge sharing between the VCOM channel capacitor and the storage capacitor; and a common center amplifier coupled to the storage capacitor, the common center amplifier controlled by a fourth switch to precharge the storage capacitor to the first middle voltage.

17. The power control system for polarity inversion in an LCD panel of claim 16, wherein the capacitance of the storage capacitor is larger than that of the VCOM channel capacitor.

* * * * *